US006340050B1

(12) United States Patent
Mori et al.

(10) Patent No.: US 6,340,050 B1
(45) Date of Patent: Jan. 22, 2002

(54) INTERNALLY GROOVED HEAT EXCHANGER PIPE AND METAL BAR WORKING ROLL FOR INTERNALLY GROOVED HEAT EXCHANGER PIPES

(75) Inventors: Yasutoshi Mori; Kouzi Yamamoto; Kenzi Nakamizo; Toshiaki Hashizume, all of Tokyo (JP)

(73) Assignee: The Furakawa Electric Co., Ltd., Tokyo (JP)

( * ) Notice: Subject to any disclaimer, the term of this patent is extended or adjusted under 35 U.S.C. 154(b) by 0 days.

(21) Appl. No.: 09/582,235

(22) PCT Filed: Nov. 22, 1999

(86) PCT No.: PCT/JP99/05844

§ 371 Date: Sep. 8, 2000

§ 102(e) Date: Sep. 8, 2000

(87) PCT Pub. No.: WO00/31486

PCT Pub. Date: Jun. 2, 2000

(30) Foreign Application Priority Data

Nov. 24, 1998 (JP) ..... 10-332666

(51) Int. Cl.[7] ..... F28F 1/40; B21B 27/02; B21H 8/02

(52) U.S. Cl. ..... 165/133; 165/184; 29/890.049; 72/197

(58) Field of Search ..... 165/133, 184; 29/890.049; 72/187, 188, 197, 221

(56) References Cited

U.S. PATENT DOCUMENTS 3,875,997 A * 4/1975 Newson et al. ..... 165/110
5,791,405 A * 8/1998 Takiura et al. ..... 165/184

FOREIGN PATENT DOCUMENTS

| | | | | |
|---|---|---|---|---|
| JP | 02078897 A | * | 3/1990 | ..... 165/184 |
| JP | 3-13796 | | 1/1991 | |
| JP | 4-158193 | | 6/1992 | |
| JP | 9-318288 | | 12/1997 | |
| JP | 10047880 A | * | 2/1998 | ..... 165/184 |
| JP | 10206060 A | * | 8/1998 | ..... 165/184 |
| JP | 10-211537 | | 8/1998 | |
| JP | 10153360 A | * | 9/1998 | |
| JP | 10-238984 | | 9/1998 | |
| JP | 11090530 A | * | 4/1999 | ..... 165/184 |
| JP | 11108579 A | * | 4/1999 | ..... 165/184 |
| JP | 11114610 A | * | 4/1999 | ..... 165/184 |

* cited by examiner

*Primary Examiner*—Allen Flanigan
(74) *Attorney, Agent, or Firm*—Oblon, Spivak, McClelland, Maier & Neustadt, P.C.

(57) ABSTRACT

An internally-grooved heat exchanger tube according to the present invention is structured such that the internal surface is divided into a plurality of continuous areas (W1, W2) parallel to the axial direction (L) of the tube, a large number of fins (10, 11) different in at least one selected among lead angle (θ, θ') to the axial direction (L) of the tube, fin vertical angle (α, α') and fin pitch (p, p') are formed in the adjacent areas (W1, W2), and a boundary portion (a) between the adjacent areas (W1, W2) is formed in the state of meandering to the axial direction (L) of the tube.

A metal strip machining roll for an internally-grooved heat exchanger tube according to the present invention is structured such that a plurality of roll pieces (**2*a*, 2*b*) each having a large number of grooves (20, 21) on each outer surface are combined together in layers parallel to the axial direction, and a contact surface (c) of one roll piece (2*a*) with its adjacent roll piece (2*b***) forms an inclined surface.

11 Claims, 11 Drawing Sheets

INTERNALLY GROOVED HEAT EXCHANGER PIPE AND METAL BAR WORKING ROLL FOR INTERNALLY GROOVED HEAT EXCHANGER PIPES

TECHNICAL FIELD

This invention relates to an internally-grooved heat exchanger tube for use in a heat exchanger of a refrigerating machine and an air conditioning machine or the like, and a metal strip machining roll for machining a metal strip for such an internally-grooved heat exchanger tube by means of rolling.

More specifically, the present invention relates to an internally-grooved heat exchanger tube structured such that the internal surface of a metal tube is divided into a plurality of continuous areas parallel to the axial direction of the tube, and fine parallel fins different in fin pattern (i.e., a fin lead angle to the axial direction of the tube, a fin vertical angle and a fin pitch or the like) are respectively formed in the adjacent areas, and a metal strip machining roll suitably used for machining a metal strip for such a heat exchanger tube by means of rolling.

BACKGROUND ART

In Japanese Patent Laid-open Nos. 3-13796 and 4-158193, for instance, there is provided an internally-grooved heat exchanger tube structured such that the internal surface of a metal tube is divided into a plurality of continuous areas parallel to the axial direction of the tube, and a large number of fins different in fin pattern are respectively formed in the adjacent areas.

A description will now be given of the internally-grooved heat exchanger tube disclosed in the above Japanese Patent Laid-open No. 3-13796 with reference to FIG. 19.

The internal surface of a metal tube 1 is divided into a plurality of continuous areas W1, W2, W1, W2 parallel to the axial direction L of the tube, and a large number of fine parallel fins 10, 11 respectively having the reversed lead angles θ, θ' to the axial direction L of the tube are formed in the adjacent areas W1, W2.

In manufacture of the internally-grooved heat exchanger tube shown in FIG. 19, a belt-like metal strip 1*a* of a certain width made of copper or copper alloy, for instance, needs to be rolled in the manner of passing such a metal strip through a gap between a machining roll 3 shown in FIG. 20 and a support roll (not shown) having a flat surface pressed against the machining roll 3.

The machining roll 3 is equivalent to a roll of a predetermined length formed by combining a plurality of disc-shaped roll pieces 3*a*, 3*b*, 3*a*, 3*b* of a predetermined thickness together in layers parallel to the axial direction, and a large number of fine parallel grooves 30, 31 respectively having the reversed lead angles θ1, θ1' to the axial direction are formed densely on the outer surfaces of the adjacent roll pieces 3*a*, 3*b*.

Thus, the large number of fins 10, 11 described above are respectively formed on one surface of the rolled metal strip 1*a* shown in FIG. 19 in the manner of transferring the large number of grooves 30, 31 of the machining rolls 3*a*, 3*b* to one surface of the rolled metal strip.

Subsequently, the metal strip 1*a* is formed in a tubular shape by the steps of setting the metal strip in an electro-uniting device (not shown) with the fin-formed surface turned to the inside, then rounding the metal strip in the cross direction in the manner of passing the metal strip through a gap between each pair of forming rolls (not shown) installed in the electro-uniting device in multiple stages, and welding the butted ends in the cross direction together.

Further, the tubular molding is formed into the metal tube 1 as shown in FIG. 19 by the steps of removing a weld bead portion from the tubular molding, and subjecting the tubular molding to sinking by a predetermined drawing device to reduce the diameter of the tubular molding to a predetermined size.

According to the heat exchanger tube shown in FIG. 19, in the case of letting the refrigerant flow toward an upper portion in the tube in FIG. 19, for instance, the refrigerant flows toward each boundary portion a' between the adjacent areas W1, W2 while being guided by the fins 10, 11, and the collision between the flows of refrigerant occurs in each boundary portion a' to form a turbulent flow, so that this turbulent flow makes it possible to prevent the temperature gradient from being caused in the refrigerant, resulting in the improvement in tube heat transfer performance.

In the case of incorporating the heat exchanger tube of the prior art described above into a heat exchanger, this heat exchanger tube accelerates the formation of the turbulent flow of refrigerant in the boundary portions a' to permit the improvement in heat transfer performance.

However, since the boundary portions a' run parallel to the axial direction L of the tube, and the interference between the turbulent flows respectively formed in the boundary portions a' before and behind the flowing direction of refrigerant occurs to thereby cancel the effects of turbulent flow each other, the sufficient heat transfer performance could not be improved.

Further, while the heat exchanger tube of the prior art may eliminate the temperature gradient parallel to the axial direction L of the tube, the temperature gradient is easily caused parallel to the peripheral direction by this heat exchanger tube, and as a result, there is a problem in that it is not possible to sufficiently improve the heat transfer performance.

An object of the present invention is to provide an internally-grooved heat exchanger tube, which makes it possible to greatly improve the tube heat transfer performance by restraining the turbulent flows of refrigerant flowing in the axial direction of the tube from interfering with each other in a boundary portion between the adjacent areas W1, W2, while sequentially guiding a turbulent-flow formed portion of the refrigerant toward the inner peripheral side of the tube.

Another object of the present invention is to provide a metal strip machining roll, which may smoothly machine a metal strip for the internally-grooved heat exchanger tube capable of achieving the above object.

DISCLOSURE OF THE INVENTION

For solving the above problems, an internally-grooved heat exchanger tube according to the present invention has the following structure.

That is, an internally-grooved heat exchanger tube in the first mode according to the present invention is characterized in that the internal surface of a metal tube 1 is divided into a plurality of continuous areas W1, W2 parallel to the axial direction L of the tube, a large number of fine parallel fins 10, 11 are respectively formed in the adjacent areas W1, W2, the fins 10 in one area W1 out of the adjacent areas and the fins 11 in the other area W2 are different in at least one selected among lead angle θ, θ' to the axial direction L of the tube, fin vertical angle α, α' and fin pitch p, p', and a boundary portion a between at least one area W1 and the other area W2 adjacent to the one area W1 is formed in the state of meandering to the axial direction L of the metal tube 1.

An internally-grooved heat exchanger tube in the second mode according to the present invention is characterized in that, in the internally-grooved heat exchanger tube in the first mode, the fins 10 formed in one area W1 out of the adjacent areas and the fins 11 formed in the other area W2 have the reversed lead angles θ, θ' to the axial direction L of the tube.

An internally-grooved heat exchanger tube in the third mode according to the present invention is characterized in that, in the internally-grooved heat exchanger tube in the second mode, the lead angle θ of each fin 10 in one area W1 out of the adjacent areas ranges from 15° to 50°, while the lead angle θ' of each fin 11 in the other area W2 ranges from −15° to −50°.

An internally-grooved heat exchanger tube in the fourth mode according to the present invention is characterized in that, in the internally-grooved heat exchanger tube in the first or second mode, the boundary portion a between the adjacent areas W1, W2 is formed in the state of meandering to the axial direction L of the tube at a certain meandering pitch P, and the meandering pitch P is 8 to 60 times as large as a cross-sectional peripheral length W of the metal tube 1.

An internally-grooved heat exchanger tube in the fifth mode according to the present invention is characterized in that, in the internally-grooved heat exchanger tube in the first or second mode, each of the fins 10, 11 in the adjacent areas W1, W2 is substantially acute triangular in cross section, and a vertical angle α of each of the fins 10, 11 ranges from 10° to 30°.

An internally-grooved heat exchanger tube in the sixth mode according to the present invention is characterized in that, in the internally-grooved heat exchanger tube in the first or second mode, a height h of each of the fins 10, 11 in the adjacent areas W1, W2 is 1/15 to 1/70 as small as an outside diameter R of the metal tube 1.

For solving the above problems, a metal strip machining roll for an internally-grooved heat exchanger tube in the first mode according to the present invention comprises a roll of a predetermined length formed by combining a plurality of roll pieces 2*a*, 2*b* together in layers parallel to the axial direction, wherein a large number of fine parallel grooves 20, 21 are respectively formed on the outer surfaces of the adjacent roll pieces 2*a*, 2*b*, the grooves 20 on one roll piece 2*a* out of the adjacent roll pieces and the grooves 21 on the other roll piece 2*b* are different in at least one selected among lead angle θ1, θ1' to the axial direction, bottom angle α1, α1' and groove pitch p1, p1', and a contact surface c of at least one roll piece 2*a* with the other roll piece 2*b* adjacent to the roll piece 2*a* forms a surface inclined at a predetermined inclination angle to the axial direction of each of the roll pieces 2*a*, 2*b*.

For solving the above problems, a metal strip machining roll for an internally-grooved heat exchanger tube in the second mode according to the present invention comprises a roll of a predetermined length formed by combining a plurality of roll pieces 2*a*, 2*b* together in layers parallel to the axial direction, wherein a large number of fine parallel grooves 20, 21 are respectively formed on the outer surfaces of the adjacent roll pieces 2*a*, 2*b*, the grooves 20 on one roll piece 2*a* out of the adjacent roll pieces and the grooves 21 on the other roll piece 2*b* are different in at least one selected among lead angle θ1, θ1' to the axial direction, bottom angle α1, α1' and groove pitch p1, p1', and a contact surface c of at least one roll piece 2*a* with the other roll piece 2*b* adjacent to the roll piece 2*a* is composed of a plurality of continuous surfaces respectively inclined at different inclination angles to the axial direction of each of the roll pieces 2*a*, 2*b*.

BRIEF DESCRIPTION OF THE DRAWINGS

FIG. 14(B) is an enlarged sectional view showing a groove on the surface of one of roll pieces of the metal strip machining roll of FIG. 14(A);

FIG. 14(C) is an enlarged sectional view showing a groove on the surface of the other roll piece of the metal strip machining roll of FIG. 14(A);

BEST MODE FOR EMBODYING THE INVENTION

Hereinafter will be described the embodiments of an internally-grooved heat exchanger tube according to the present invention with reference to FIGS. 1 to 18.

First Embodiment

Figure 1:
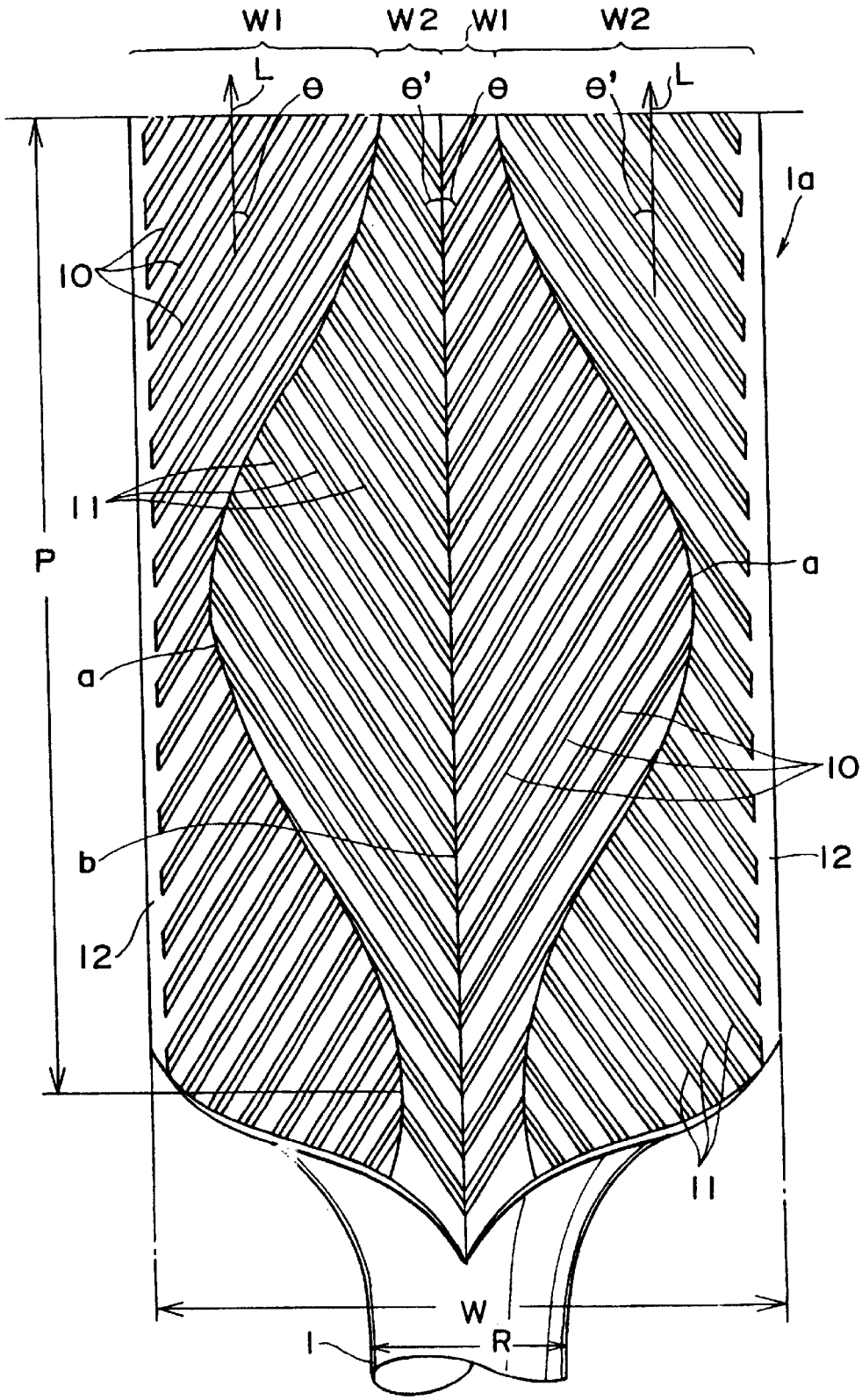
FIG. 1 is a partially development plan view showing an internally-grooved heat exchanger tube in the first embodiment according to the present invention.

As shown in FIG. 1, the internal surface of a metal tube 1 made of deoxidized copper and having a thickness of 0.25 mm and a peripheral length W (i.e., a width of a rolled metal strip 1*a*) of 21 mm (an outside diameter of about 6.7 mm) is divided into four continuous areas W1, W2, W1, W2 parallel to the axial direction L of the tube such that the width of each of the areas varies parallel to the peripheral direction.

While a developed portion of the metal tube 1 shows a rolled metal strip 1*a*, boundary portions a between the adjacent areas W1, W2 on the opposite sides of the rolled metal strip 1*a* are formed in the state of regular meandering to the axial direction L of the tube at a certain meandering pitch P of about 377 mm while maintaining a certain meandering width (6 mm), and a boundary portion b between the adjacent areas W2, W1 in the center is formed parallel to the axial direction L of the tube, as a matter of fact.

Figure 3:
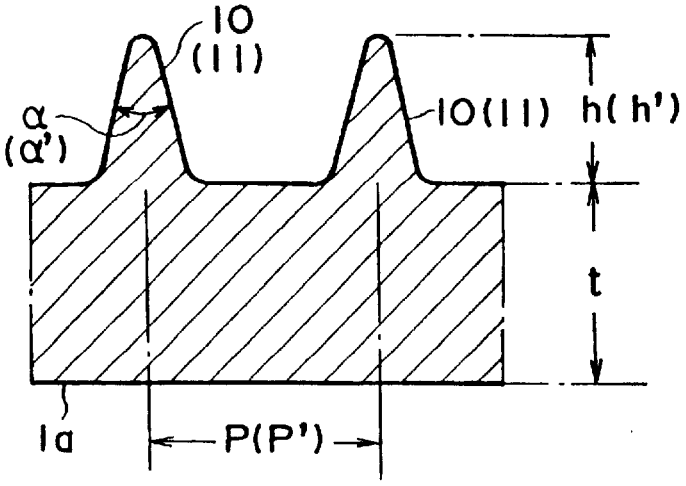
FIG. 3 is a partially enlarged sectional view showing a rolled metal strip before the internally-grooved heat exchanger tube in the first embodiment of FIG. 1 is manufactured.

A large number of parallel fins 10 each having a lead angle θ of 20° to the axial direction L of the tube, a height (i.e., a height from the bottom) h of 0.2 mm and a vertical angle α of 30° as shown in FIG. 3 are formed in each odd-numbered area W1, while a large number of parallel fins 11 each having a reversed lead angle θ' of −20° to the axial direction L of the tube, a height h' of 0.2 mm and a vertical angle aα of 30° are formed in each even-numbered area W2 respectively adjacent to the odd-numbered areas W1. A narrow flat portion 12 is formed on the opposite edges of the rolled metal strip 1*a* in the cross direction.

The pitches p, p' (i.e., the mean interval between the centers of the fin tops in the ringed cross-sectional circumference of the metal tube 1) of the fins 10, 11 are set to be equal to about 0.31 mm on an average.

Figure 2:
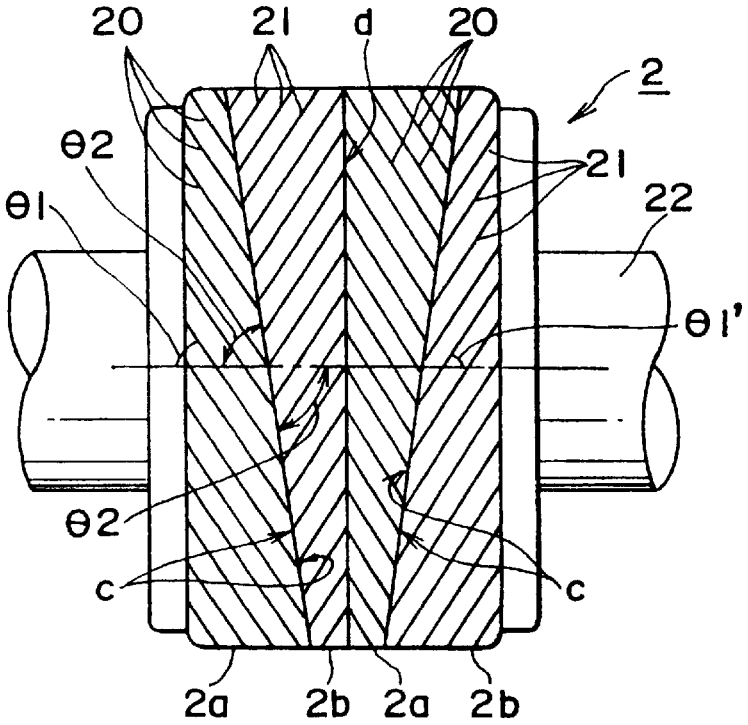
FIG. 2 is a schematic front view showing a metal strip machining roll for manufacturing the internally-grooved heat exchanger tube in the first embodiment according to the present invention.

A metal strip machining roll 2 shown in FIG. 2 is used for manufacturing the internally-grooved heat exchanger tube in the first embodiment.

The machining roll 2 is structured such that a plurality of roll pieces 2*a*, 2*b*, 2*a*, 2*b* made of hard metal is fixed to a shaft 22 in layers parallel to the axial direction, and a contact surface c of one roll piece 2*a* out of a set of adjacent roll pieces with the other roll piece 2*b* forms a surface inclined at a predetermined inclination angle θ2 to the axial direction of the roll pieces 2*a*, 2*b*. A contact surface d of the second roll piece 2*b* from the left with the third roll piece 2*a* crosses at a right angle to the axial direction.

A large number of parallel grooves 20, 21 respectively having the reversed lead angles θ1, θ1' to the axial direction are formed on the outer surfaces of the roll pieces 2*a*, 2*b* at the same pitch (i.e., an interval between the groove tops in the longitudinal direction of the roll 2) so as to correspond to the fins 10, 11 of the metal tube 1.

In the machining roll 2 in this mode, the outside diameter (i.e., an outside diameter of the groove bottom) of each of the roll pieces 2*a*, 2*b* is 120 mm, the inclination angle θ2 of the contact surface c of the roll piece 2*a* with its adjacent roll piece 2*b* to the axial direction is about 3°, and each of the lead angles θ1, θ1' of the grooves 20, 21 to the axial direction is ±20°.

When the metal strip is rolled by the machining roll 2 as described in the above embodiment together with a support roll (not shown) having a flat surface, four areas W1, W2, W1, W2 are formed on one surface of the rolled metal strip 1a, while the large number of fine parallel fins 10, 11 are formed in the areas W1, W2 correspondingly to the roll pieces 2*a*, 2*b* and also the large number of grooves 20, 21 formed on these roll pieces, as shown in FIG. 1.

In the rolled metal strip 1*a*, each boundary portion a between the odd-numbered area W1 from the left and the even-numbered area W2 is formed in the state of meandering to the axial direction of the tube at a pitch P (of about 377 mm) corresponding to the cross-sectional peripheral length of each of the roll pieces 2*a*, 2*b*, while maintaining a meandering width corresponding to the inclination angle of each contact surface c of the odd-numbered roll piece 2*a* with the even-numbered roll piece 2*b* adjacent to the roll piece 2*a* in the machining roll 2.

After the large number of fins 10, 11 have been formed in the areas W1, W2 of one surface of the rolled metal strip 1*a* as shown in FIG. 1, this rolled metal strip 1*a* is formed into the shape of the metal tube 1 as shown in FIG. 1 according to the similar procedure to the conventional method described above.

According to the metal tube 1 serving as the internally-grooved heat exchanger tube in the first embodiment, when this metal tube is incorporated into a heat exchanger (not shown) to let the refrigerant flow within the tube in parallel to the axial direction L of the tube (toward an upper portion in FIG. 1), the refrigerant flows along the fins 10, 11 formed in the adjacent areas W1, W2, and the collision between the flows of refrigerant occurs in each boundary portion a between the areas W1, W2 to form a turbulent flow, so that this turbulent flow makes it possible to accelerate the exchange of heat between the refrigerant and the internal surface of the tube, resulting in the improvement in heat transfer efficiency.

At this time, since each boundary portion a between the areas W1, W2 to cause the collision between the flows of refrigerant for the formation of a turbulent flow is formed in the state of meandering to the axial direction L of the tube so that positions of a refrigerant collision/turbulent-flow formed portion (i.e., the boundary portion a) in the inner peripheral direction of the tube are different little by little before and behind the flowing direction of refrigerant, the interference between the turbulent flows formed before and behind the flowing direction of refrigerant is restrained to thereby make it possible to prevent the heat transfer efficiency from being reduced.

Further, since the refrigerant collision/turbulent-flow formed portion is shifted in a zigzag shape along each meandering boundary portion a toward the inner peripheral side of the tube, the temperature gradient parallel to the peripheral direction is also restrained to thereby make it possible to sufficiently improve the heat transfer performance.

EXAMPLE 1

A metal strip made of deoxidized copper was used to manufacture a heat exchanger tube as the example 1 according to the present invention based on the mode as shown in FIG. 1, that is, a heat exchanger tube structured such that the internal surface of the tube is divided into four continuous areas W1, W2, W1, W2 parallel to the axial direction of the tube, the cross-sectional peripheral length W (i.e., the width of the metal strip) is 21 mm, the thickness (i.e., the thickness of the groove bottom) t is 0.25 mm, the meandering pitch P of the boundary portion a between the adjacent areas W1, W2 is 30W (630 mm), the meandering width of the boundary portion a is 6 mm, each of the heights h, h' of the fins 10, 11 is 0.2 mm, each of the pitches p, p' of the fins 10, 11 is 0.31 mm, each of the fin vertical angles $\alpha$, $\alpha'$ is 30°, the lead angle $\theta$ of each fin 10 to the axial direction L of the tube is 20°, and the lead angle $\theta^{\circ\prime}$ of each fin 11 to the axial direction L of the tube is −20°.

COMPARATIVE EXAMPLE 1

Figure 19:
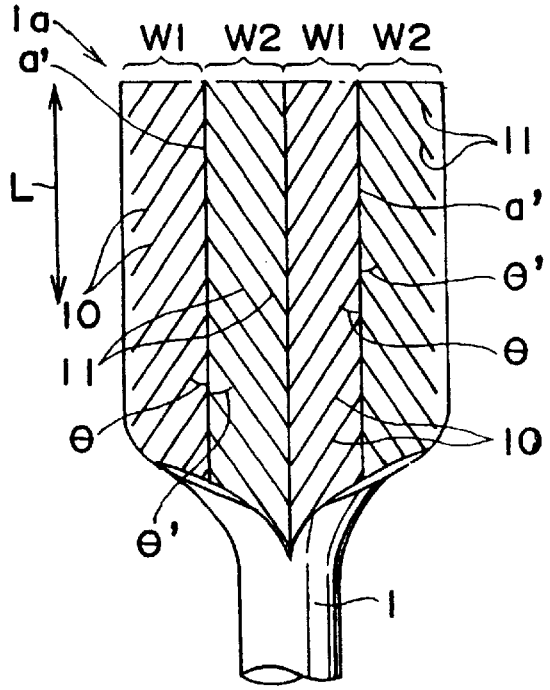
FIG. 19 is a partially development view showing an internally-grooved heat exchanger tube in the prior art as described in Japanese Patent Laid-open No. 3-13796.
Figure 20:
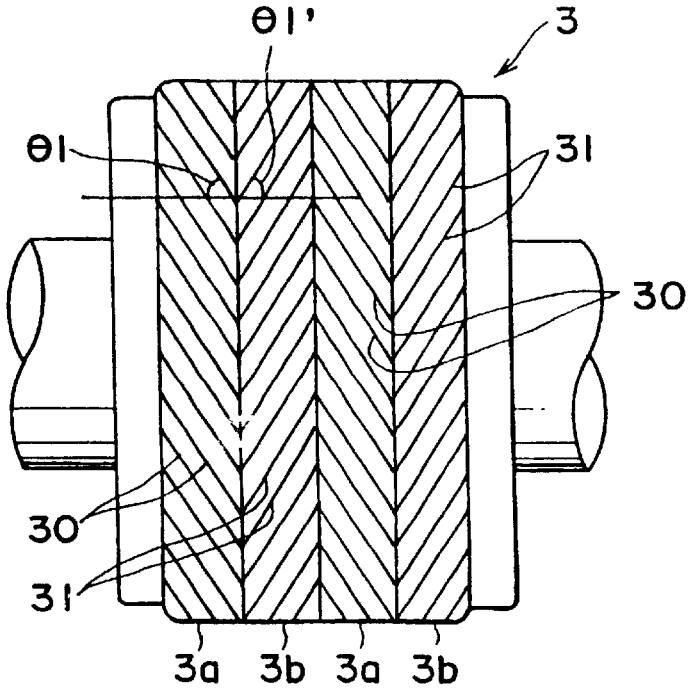
FIG. 20 is a schematic front view showing a metal strip machining roll for manufacturing the internally-grooved heat exchanger tube of FIG. 19.

A metal strip made of deoxidized copper was used to manufacture a heat exchanger tube as the comparative example based on the prior art mode as shown in FIG. 19, that is, a heat exchanger tube structured such that the internal surface of the tube is divided into four uniform areas W1, W2, W1, W2 parallel to the peripheral direction, the cross-sectional peripheral length W is 21 mm, the thickness (i.e., the thickness of the groove bottom) t is 0.25 mm, the height h of each of the fins 10, 11 is 0.2 mm, the pitch of the fins 10, 11 is 0.31 mm, the vertical angle of each fin is 30°, the lead angle $\theta$ of each fin 10 to the axial direction L of the tube is 20° and the lead angle $\theta'$ of each fin 11 to the axial direction L of the tube is −20°.

The measurement of the coefficient of heat transfer with condensation and that of the coefficient of heat transfer with vaporization were made on the heat exchanger tube as the example 1 and the heat exchanger tube as the comparative example 1 every flow rate of refrigerant by making it condition that the flow rate of refrigerant was varied. The percentage of the coefficient of heat transfer with condensation and that of the coefficient of heat transfer with vaporization are shown in Tables 1,2. Each percentage of the coefficient of heat transfer was given by making the measurement ten times on both the heat exchanger tubes in the state of a single tube by using a measuring device, and then finding the average of the measured values to make a comparison by assuming each measured value of the heat exchanger tube as the comparative example on the basis of each flow rate of refrigerant to be 100.

As shown in Tables 1, 2, it was ascertained that the heat transfer performance of the heat exchanger tube as the example 1 according to the present invention was improved greater than that of the heat exchanger tube as the comparative example, that is, the heat exchanger tube as the example 1 produced an increase 48 to 62% in coefficient of heat transfer with condensation and an increase of 28 to 38% in coefficient of heat transfer with vaporization.

TABLE 1

(Percentage of coefficient of heat transfer with condensation)

| Flow rate of refrigerant ($kg/m^2$ s) | Heat exchanger tube as comparative example | Heat exchanger tube as example |
|---|---|---|
| 150 | 100 | 148 |
| 200 | 100 | 152 |
| 250 | 100 | 156 |
| 300 | 100 | 162 |
| 350 | 100 | 154 |
| 400 | 100 | 150 |

TABLE 2

(Percentage of coefficient of heat transfer with vaporization)

| Flow rate of refrigerant ($kg/m^2$ s) | Heat exchanger tube as comparative example | Heat exchanger tube as example |
|---|---|---|
| 150 | 100 | 128 |
| 200 | 100 | 131 |
| 250 | 100 | 134 |
| 300 | 100 | 138 |
| 350 | 100 | 133 |
| 400 | 100 | 130 |

EXAMPLE 2

8 kinds of heat exchanger tubes as the example 2 were manufactured by making it condition that the constituent elements were set to be equal to those of the heat exchanger tube as the example 1, except that each of the vertical angles $\alpha$, $\alpha'$ of the fins 10, 11 was varied within the range of 5 to 40°, and the meandering pitch P of the boundary portion a between the adjacent areas W1, W2 was set to 30W (wherein W represents the cross-sectional peripheral length of the tube).

Subsequently, the measurement of the coefficient of heat transfer with condensation in the case of setting the flow rate of refrigerant to 200 $Kg/m^2s$ was made on each of the above heat exchanger tubes. The percentage of the coefficient of heat transfer with condensation in each of the heat exchanger tubes as the example 2 is shown in Table 3.

Each percentage of the coefficient of heat transfer was given by making the measurement ten times on each of the heat exchanger tubes in the state of a single tube by using a measuring device and then finding the average of the measured values to make a comparison by assuming the percentage of the coefficient of heat transfer with condensation in the heat exchanger tube having the fin vertical angles $\alpha$, $\alpha'$ of 30° as the example 2 to be 100.

As shown in Table 3, it was ascertained that the preferable range of each of the fin vertical angles α, α' was 10 to 30, on the tube diameter or the fin density.

TABLE 3

(Relation between change in fin vertical angle α and percentage of coefficient of heat transfer with condensation, wherein flow rate of refrigerant is set to 200 Kg/m$^2$ s)

| Fin vertical angle α (°) | Percentage of coefficient of heat transfer with condensation (Heat exchanger tube having α of 30° is assumed to be 100) |
|---|---|
| 5 | 90 |
| 10 | 117 |
| 15 | 119 |
| 20 | 114 |
| 25 | 110 |
| 30 | 100 |
| 35 | 85 |
| 40 | 78 |

Second Embodiment

Figure 4:
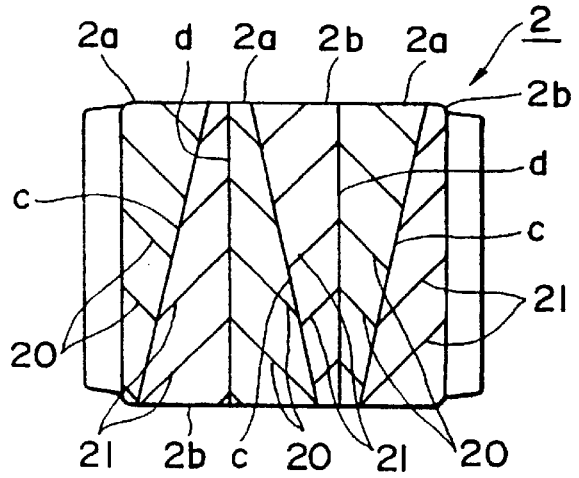
FIG. 4 is a schematic front view showing a metal strip machining roll for manufacturing an internally-grooved heat exchanger tube in the second embodiment according to the present invention.

A metal strip machining roll 2 shown in FIG. 4 is formed by combining three sets of roll pieces 2*a*, 2*b*, i.e., six roll pieces in total structured such that each of contact surfaces c facing each other forms a surface uniformly inclined to the axial direction of the roll, while each of other contact surfaces d forms a surface perpendicular to the axial direction of the roll.

The odd-numbered roll pieces 2*a* and the even-numbered roll pieces 2*b* are respectively placed in alternately inverse positions.

Figure 5:
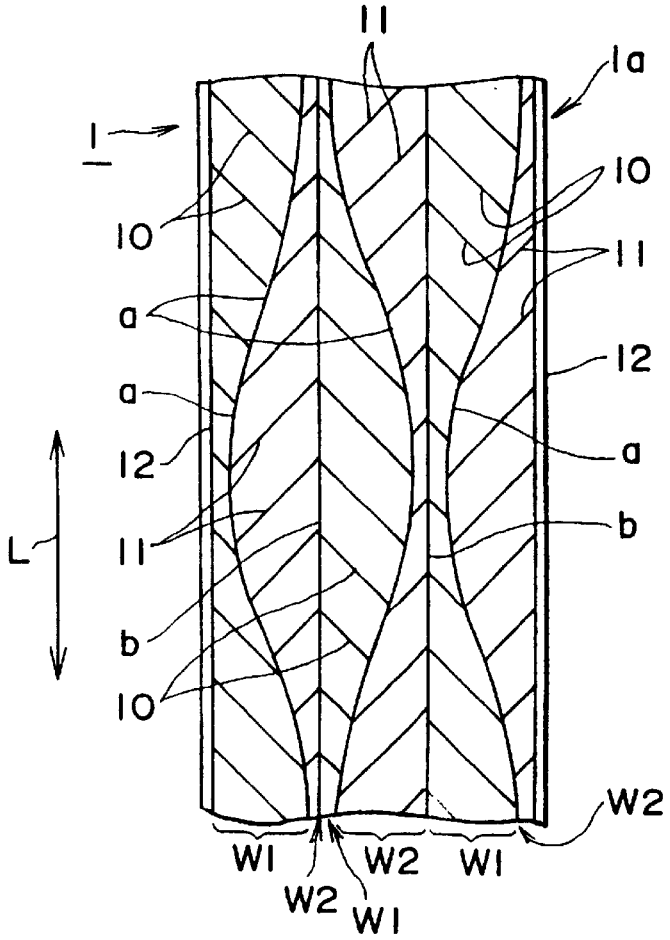
FIG. 5 is a partially development plan view schematically showing the internally-grooved heat exchanger tube in the second embodiment manufactured by using the metal strip machining roll of FIG. 4.

In the internally-grooved heat exchanger tube in the second embodiment manufactured by using the metal strip machining roll 2 shown in FIG. 4, a rolled metal strip 1*a* is machined as shown in the tube in FIG. 5.

The internally-grooved heat exchanger tube in the second embodiment has more boundary portions a meandering to the axial direction of the tube than the internally-grooved heat exchanger tube in the first embodiment, and therefore, shows the greater improvement in coefficient of heat transfer as long as both the heat exchanger tubes are equal in outside diameter to each other in the case of letting the refrigerant flow from an upper portion to a lower portion in the tube in FIG. 5.

Further, using a heat exchanger tube having a larger outside diameter does much to improve the coefficient of heat transfer with the increase in number of the continuous areas W1, W2 parallel to the axial direction L of the tube, together with the increase in number of the meandering boundary portions a between the areas, like the heat exchanger tube in the second embodiment.

Other constitution, operation and effects of the internally-grooved heat exchanger tube in the second embodiment are similar to those of the heat exchanger tube in the first embodiment, and hence, the description thereof will be omitted.

Third Embodiment

Figure 6:
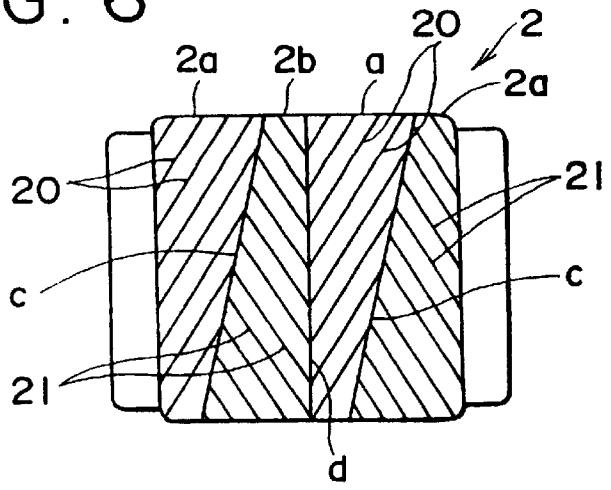
FIG. 6 is a schematic front view showing a metal strip machining roll for manufacturing an internally-grooved heat exchanger tube in the third embodiment according to the present invention.

A metal strip machining roll 2 shown in FIG. 6 is formed by combining two sets of roll pieces 2*a*, 2*b* structured such that each of contact surfaces c forms a surface inclined uniformly to the axial direction of the roll, while the other contact surface forms a surface perpendicular to the axial direction of the roll. The odd-numbered roll pieces 2*a* and the even-numbered roll pieces 2*b* are respectively placed in similar positions.

Figure 7:
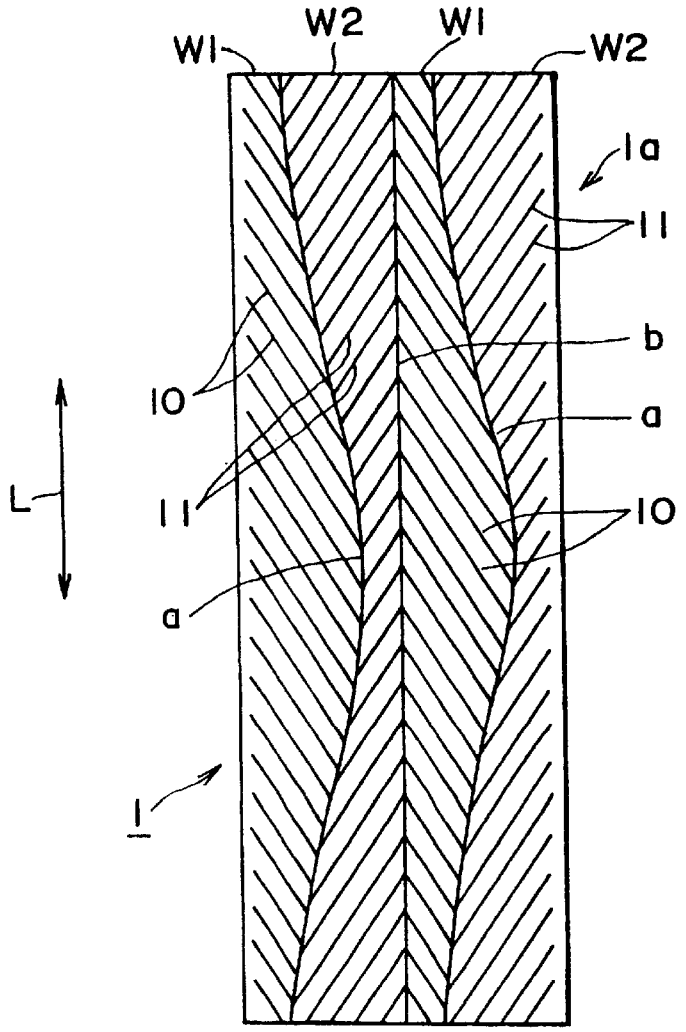
FIG. 7 is a partially development plan view schematically showing the internally-grooved heat exchanger tube in the third embodiment manufactured by using the metal strip machining roll of FIG. 6.

In an internally-grooved heat exchanger tube in the third embodiment manufactured by using the metal strip machining roll 2 shown in FIG. 6, a rolled metal strip 1*a* is machined as shown in FIG. 7.

Two lines of boundary portions a meandering to the axial direction L of the tube are formed on the internal surface of the internally-grooved heat exchanger tube in the third embodiment so as to be similar in position in the axial direction L of the tube, meandering direction and meandering amount to each other.

Other constitution, operation and effects of the internally-grooved heat exchanger tube in the third embodiment are similar to those of the internally-grooved heat exchanger tube in the first embodiment, and hence, the description thereof will be omitted.

Fourth Embodiment

Figure 8:
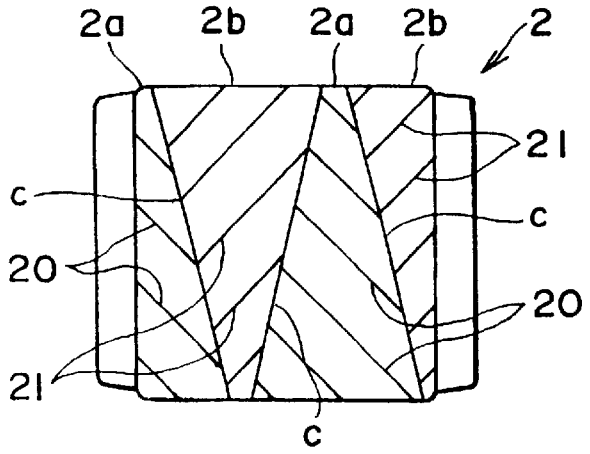
FIG. 8 is a schematic front view showing a metal strip machining roll for manufacturing an internally-grooved heat exchanger tube in the fourth embodiment according to the present invention.

A metal strip machining roll 2 shown in FIG. 8 is formed by combining two sets of roll pieces 2*a*, 2*b* structured such that each of contact surfaces c forms a surface uniformly inclined to a surface perpendicular to the axial direction of the roll. Each of the outside end surfaces of the opposite-end roll pieces 2*a*, 2*b* is formed perpendicularly to the axial direction of the roll, while a contact surface c of the roll piece 2*b* with its adjacent roll piece 2*a* in the center is uniformly inclined to a surface perpendicular to the axial direction of the roll.

Figure 9:
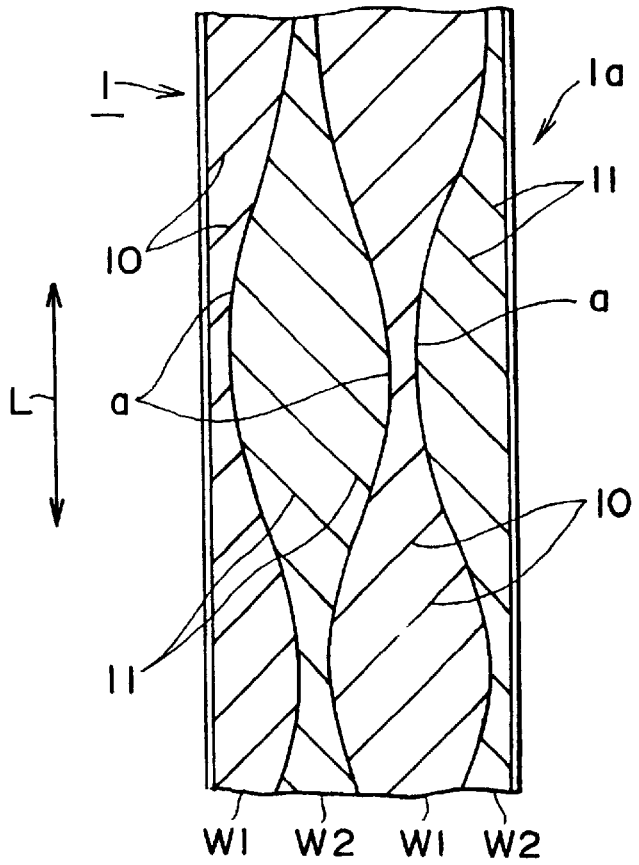
FIG. 9 is a partially development plan view schematically showing the internally-grooved heat exchanger tube in the fourth embodiment manufactured by using the metal strip machining roll of FIG. 8.

In an internally-grooved heat exchanger tube in the fourth embodiment manufactured by using the metal strip machining roll 2 shown in FIG. 8, a rolled metal strip 1*a* is machined as shown in FIG. 9.

A boundary portion a meandering to the axial direction L of the tube is formed between the adjacent areas W1, W2, between those W2, W1 and between those W1, W2 in order from the left in FIG. 9 on the internal surface of the internally-grooved heat exchanger tube in the fourth embodiment.

In the case of letting the refrigerant flow from a lower portion to an upper portion in the heat exchanger tube in FIG. 9, the turbulent flow of refrigerant is formed mainly at portions of the opposite boundary portions a, a. On the other hand, in the case of letting the refrigerant flow from the upper portion to the lower portion in FIG. 9, the turbulent flow of refrigerant is formed mainly at a portion of the center boundary portion a.

Thus, as long as one surface of the rolled metal strip 1*a* is divided into five continuous areas parallel to the axial direction L of the heat exchanger tube, and each boundary portion a meandering to the axial direction L of the tube is formed between the adjacent areas, the boundary portions a of the same number may be available for the formation of the turbulent flow of refrigerant even when the refrigerant flows in any direction, so that the substantially uniform heat transfer efficiency may be achieved even in the case of letting the refrigerant flow within the heat exchanger tube in any direction.

Other constitution, operation and effects of the internally-grooved heat exchanger tube in the fourth embodiment are similar to those of the heat exchanger tube in the first embodiment, and hence, the description thereof will be omitted.

Fifth Embodiment

Figure 10:
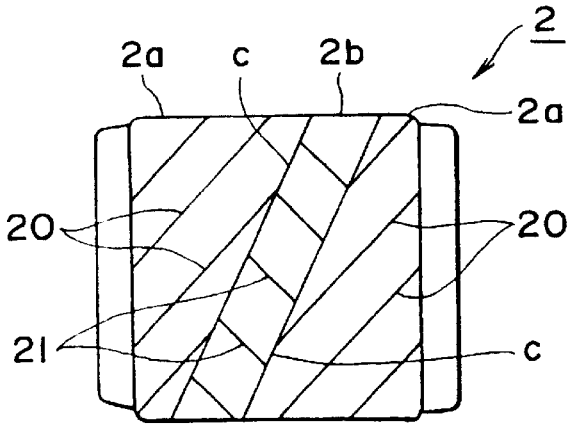
FIG. 10 is a schematic front view showing a metal strip machining roll for manufacturing an internally-grooved heat exchanger tube in the fifth embodiment according to the present invention.

A metal strip machining roll 2 shown in FIG. 10 is formed by combining three roll pieces 2*a*, 2*b*, 2*a* together, contact surfaces c of the opposite roll pieces 2*a* with the center roll piece 2*b* are uniformly inclined to the axial direction of the roll, and the opposite roll pieces 2*a*, 2*a* are in contact with the center roll piece 2*b* in alternately inverse positions.

Figure 11:
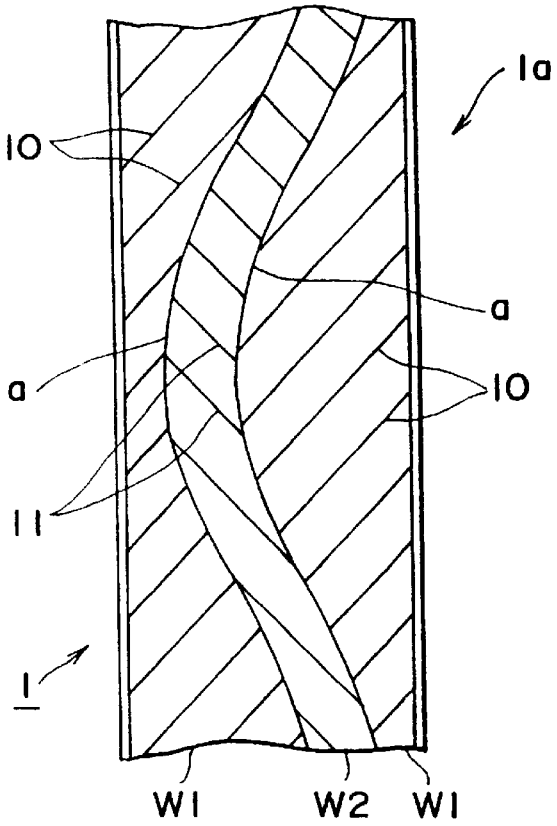
FIG. 11 is a partially development plan view schematically showing the internally-grooved heat exchanger tube in the fifth embodiment manufactured by using the metal strip machining roll of FIG. 10.

In an internally-grooved heat exchanger tube in the fifth embodiment manufactured by using the metal strip machining roll 2 shown in FIG. 10, a rolled metal strip 1*a* is machined as shown in FIG. 11.

A boundary portion a meandering to the axial direction L of the tube is formed between the areas W1, W2 and between those W2, W1 on the internal surface of the internally-grooved heat exchanger tube in the fifth embodiment. These boundary portions a are parallel to each other.

According to the internally-grooved heat exchanger tube in the fifth embodiment, the substantially uniform heat transfer efficiency may be achieved even in the case of letting the refrigerant flow in any direction.

Other constitution, operation and effects of the internally-grooved heat exchanger tube in the fifth embodiment are similar to those of the heat exchanger tube in the first embodiment, and hence, the description thereof will be omitted.

Sixth Embodiment

Figure 12:
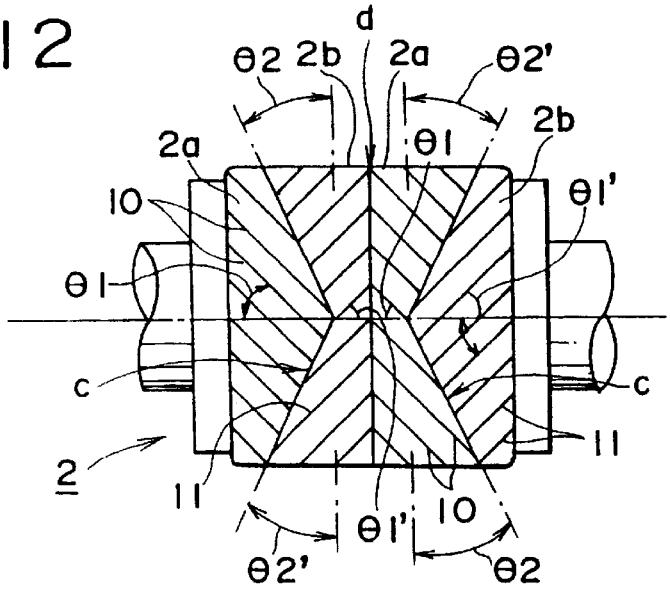
FIG. 12 is a schematic front view showing a metal strip machining roll for manufacturing an internally-grooved heat exchanger tube in the sixth embodiment according to the present invention.

A metal strip machining roll 2 shown in FIG. 12 is formed by combining four roll pieces 2*a*, 2*b*, 2*a*, 2*b* together in layers parallel to the axial direction, and a large number of fine parallel grooves 20, 21 respectively having the reversed lead angles θ1, θ1' to the axial direction are formed on the surfaces of the adjacent roll pieces 2*a*, 2*b*.

A contact surface c of the roll piece 2*a* with its adjacent roll piece 2*b* is composed of a surface inclined at a predetermined inclination angle θ2 to a surface perpendicular to the axial direction of the roll 2 and a surface continuous to the above inclined surface and also inclined at the reversed inclination angle θ2' to the surface perpendicular to the axial direction of the roll 2.

A contact surface d of the roll piece 2*b* with its adjacent roll piece 2*a* in the center forms a surface perpendicular to the axial direction of the roll 2.

Figure 13:
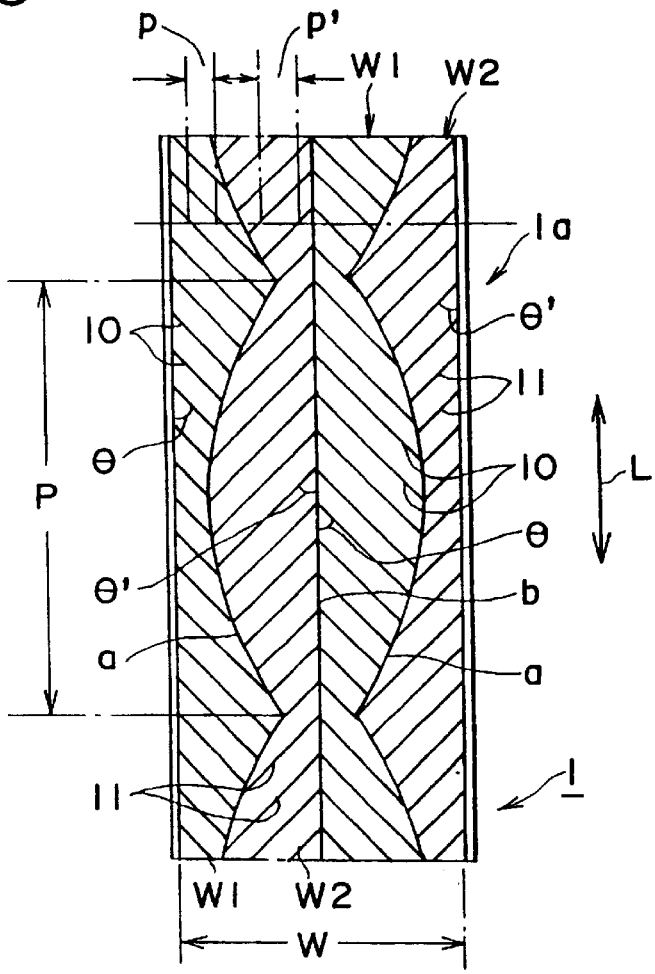
FIG. 13 is a partially development plan view schematically showing the internally-grooved heat exchanger tube in the sixth embodiment manufactured by using the metal strip machining roll of FIG. 12.

In an internally-grooved heat exchanger tube in the sixth embodiment manufactured by using the metal strip machining roll 2 shown in FIG. 12, a rolled metal strip la is machined as shown in FIG. 13.

The internal surface of the internally-grooved heat exchanger tube in the sixth embodiment is divided into four areas W1, W2, W1, W2 correspondingly to the roll pieces 2*a*, 2*b*, and each boundary portion a meandering to the axial direction L of the tube at a certain pitch P is formed between the adjacent areas W1, W2 correspondingly to each contact surface c. The boundary portions a, a are formed symmetrically in the state of meandering without being parallel to each other. A center boundary portion b between the adjacent areas W2, W1 is formed parallel to the axial direction L of the tube.

A large number of fine parallel fins 10 each having a predetermined lead angle θ to the axial direction L of the tube are formed in one area W1 out of the adjacent areas correspondingly to the grooves 20, while a large number of fine parallel fins 11 each having the reversed lead angle θ' of the lead angle θ to the axial direction L of the tube are formed in the area W2 adjacent to the area W1 correspondingly to the grooves 21. The pitches p, p' of the fins 10, 11 are equal to each other.

According to the metal strip machining roll 2 in the sixth embodiment, since each contact surface c of the roll piece 2*a* with its adjacent roll piece 2*b* is composed of a plurality of continuous surfaces respectively inclined at different inclination angles to the surface perpendicular to the axial direction of the roll 2, each boundary portion a between the adjacent areas W1, W2 formed on the metal strip 1*a* is formed at a smaller pitch P of meandering to the axial direction L of the tube, in comparison with the case of the metal strip machining roll 2 in the first embodiment, even though the roll 2 of a relatively larger diameter is in use.

The boundary portions a are formed at the smaller meandering pitch P as described above, and as a result, the internally-grooved heat exchanger tube in the sixth embodiment may improve the heat transfer performance greater than that of the internally-grooved heat exchanger tube in the first embodiment.

The metal strip machining roll and the internally-grooved heat exchanger tube in the sixth embodiment are substantially similar in other constitution, operation and effects to those in the first embodiment.

EXAMPLE 3

A metal strip made of deoxidized copper was used to manufacture a heat exchanger tube as the example 3 according to the present invention based on the mode as shown in FIG. 13 (the sixth embodiment), that is, a heat exchanger tube structured such that the internal surface of the tube is divided into four continuous areas W1, W2, W1, W2 parallel to the axial direction of the tube, the cross-sectional peripheral length W (i.e., the width of the metal strip) is 20 mm, the thickness (i.e., the thickness of the groove bottom) t is 0.25 mm, the meandering pitch P of the boundary portion a between the adjacent areas W1, W2 is 15W (300 mm), the meandering width of the boundary portion a is 6 mm, each of the heights h, h' of the fins 10, 11 is 0.2 mm, each of the pitches p, p' of the fins 10, 11 is 0.22 mm, each of the fin vertical angles α, α' is 25° the lead angle θ of each fin 10 to the axial direction L of the tube is 20°, and the lead angle θ of each fin 11 to the axial direction L of the tube is −20°.

COMPARATIVE EXAMPLE 3

A metal strip made of deoxidized copper was used to manufacture a heat exchanger tube as the comparative example 3 based on the prior art mode as shown in FIG. 19, that is, a heat exchanger tube structured such that the internal surface of the tube is divided into four uniform areas W1, W2, W1, W2 parallel to the peripheral direction, the cross-sectional peripheral length W is 20 mm, the thickness (i.e., the thickness of the groove bottom) t is 0.25 mm, the height h of each of the fins 10, 11 is 0.2 mm, the pitch of the fins 10, 11 is 0.22 mm, each fin vertical angle is 25°, the lead angle θ of each fin 10 to the axial direction L of the tube is 20°, and the lead angle θ of each fin 11 to the axial direction L of the tube is −20°.

The measurement of the coefficient of heat transfer with condensation and that of the coefficient of heat transfer with vaporization were made on the heat exchanger tube as the example 3 and the heat exchanger tube as the comparative example 3 every flow rate of refrigerant by making it condition that the flow rate of refrigerant was varied. The percentage of the coefficient of heat transfer with condensation and that of the coefficient of heat transfer with vaporization are shown in Tables 4, 5. Each percentage of the coefficient of heat transfer was given by making the measurement ten times on both the heat exchanger tubes in the state of a single tube by using a measuring device, and then finding the average of the measured values to make a comparison by assuming each measured value of the heat exchanger tube as the comparative example 3 on the basis of each flow rate of refrigerant to be 100.

As shown in Tables 4, 5, it was ascertained that the heat transfer performance of the heat exchanger tube as the example 3 according to the present invention was improved greater than that of the heat exchanger tube as the comparative example 3, that is, the heat exchanger tube as the example 3 produced an increase of 58 to 71 % in coefficient of heat transfer with condensation and also an increase of 38 to 48% in coefficient of heat transfer with vaporization.

TABLE 4

(Percentage of coefficient of heat transfer with condensation)

| Flow rate of refrigerant ($kg/m^2$ s) | Heat exchanger tube as comparative example | Heat exchanger tube as example |
|---|---|---|
| 150 | 100 | 158 |
| 200 | 100 | 163 |
| 250 | 100 | 166 |
| 300 | 100 | 171 |
| 350 | 100 | 167 |
| 400 | 100 | 165 |

TABLE 5

(Percentage of coefficient of heat transfer with vaporization)

| Flow rate of refrigerant ($kg/m^2$ s) | Heat exchanger tube as comparative example | Heat exchanger tube as example |
|---|---|---|
| 150 | 100 | 138 |
| 200 | 100 | 141 |
| 250 | 100 | 144 |
| 300 | 100 | 148 |
| 350 | 100 | 143 |
| 400 | 100 | 140 |

EXAMPLE 4

20 kinds of heat exchanger tubes as the example 4 were manufactured by making it condition that the constituent elements were set to be equal to those of the heat exchanger tube as the example 3 except that the meandering pitch P of each boundary portion a between the adjacent areas W1, W2 was varied within the range of 4 to 80 W times as large as the cross-sectional peripheral length W of the tube (i.e., the width of the metal strip 1*a*)

Subsequently, the measurement of the coefficient of heat transfer with condensation in the case of setting the flow rate of refrigerant to 200 $Kg/m^2$ s was made on each of the above heat exchanger tubes. The percentage of the coefficient of heat transfer with condensation of each of the above heat exchanger tubes as the example 4 is shown in Table 6, together with the presence or absence of roll chipping (broken grooves 20, 21 of the machining roll 2) in the case of rolling the metal strip.

The percentage of the coefficient of heat transfer in each heat exchanger tube was given by making the measurement ten times on each heat exchanger tube in the state of a single tube by using a measuring device and then finding the average of the measured values to substitute the average value with a value as of the time of assuming the coefficient of heat transfer with condensation (the flow rate of refrigerant is set to 200 $Kg/m^2$ s) in the heat exchanger tube as the comparative example 3 to be 100.

As to the occurrence of roll chipping, the presence of roll chipping at the time of rolling the metal strip is expressed by x, while the absence of roll chipping is expressed by ○.

As shown in Table 6, when the meandering pitch P of each boundary portion a was four times as large as the cross-sectional peripheral length W of the tube, high coefficient of heat transfer was ensured, while the roll chipping occurred at the time of rolling the metal strip.

On the other hand, when the meandering pitch P of each boundary portion a exceeded 60 times as large as the cross-sectional peripheral length W of the tube, it was ascertained that a difference in coefficient of heat transfer with condensation between the heat exchanger tube as the example 4 and that as the comparative example was reduced. It is supposed that the above fact results from the interference between the turbulent flows formed at butted portions of the fins on the boundary line portions a for the reason that the meandering pitch P exceeds 60W to extremely reduce the number of meandering portions per unit length of each boundary portion a.

Judging from the above result, the meandering pitch P of each boundary portion a to the axial direction L of the tube is preferably 8 to 60 times as large as the cross-sectional peripheral length W of the tube, depending on the outside diameter of the metal tube 1, the number of areas W1, W2, the fin height or the like.

TABLE 6

(Relation of meandering pitch P of boundary portion a between areas W1, W2 to coefficient of heat transfer with condensation, and also to occurrence of roll chipping, wherein flow rate of refrigerant is set to 200 $kg/m^2$ s)

| Meandering pitch P of boundary portion a (W to P ratio) | Percentage of coefficient of heat transfer with condensation (Heat exchanger tube as comparative example is assumed to be 100) | Occurrence of roll chipping |
|---|---|---|
| 4W | 163 | X |
| 8W | 163 | ○ |
| 12W | 163 | ○ |
| 16W | 155 | ○ |
| 20W | 154 | ○ |
| 24W | 153 | ○ |
| 28W | 153 | ○ |
| 32W | 150 | ○ |
| 36W | 148 | ○ |
| 40W | 146 | ○ |
| 44W | 145 | ○ |
| 48W | 143 | ○ |
| 52W | 142 | ○ |
| 56W | 138 | ○ |
| 60W | 134 | ○ |
| 64W | 119 | ○ |
| 68W | 108 | ○ |
| 72W | 104 | ○ |
| 76W | 103 | ○ |
| 80W | 101 | ○ |

EXAMPLE 5

12 kinds of heat exchanger tubes were manufactured by making it condition that the constituent elements were set to be equal to those of the heat exchanger tube as the example 3 except that the lead angles θ, θ' of the fins 10, 11 to the axial direction L of the tube were varied within the range of ±50° to ±60°, and the meandering pitch P of each boundary portion a between the adjacent areas W1, W2 was set to 15W (W represents the cross-sectional peripheral length of the heat exchanger tube).

Subsequently, the measurement of the coefficient of heat transfer with condensation in the case of setting the flow rate of refrigerant to 200Kg/m$^2$ s was made on each of the above heat exchanger tubes as the example 5. The percentage of the coefficient of heat transfer with condensation in each heat exchanger tube as the example 5 is shown in Table 7.

The percentage of the coefficient of heat transfer in each heat exchanger tube was given by making the measurement ten times on each heat exchanger tube in the state of a single tube by using a measuring device and then finding the average of the measured values to make a comparison by assuming the percentage of the coefficient of heat transfer with condensation in the heat exchanger tube having the fin lead angles θ, θ' of ±20° to the axial direction L of the tube to be 100.

As shown in table 7, it was ascertained that the preferable range of the lead angle 0 of each fin 10 was 15 to 50°, while that of the lead angle 0' of each fin 11 was −15 to −50°, depending on the outside diameter of the tube or other elements.

TABLE 7

(Relation between change in lead angles θ, θ' of fins and coefficient of heat transfer with condensation, wherein flow rate of refrigerant is set to 200 kg/m$^2$ s)

| Lead angle θ, θ' of fin (±°) | Percentage of coefficient of heat transfer with condensation (Heat exchanger tube having θ, θ' of ±20° is assumed to be 100) |
|---|---|
| 5 | 60 |
| 10 | 76 |
| 15 | 96 |
| 20 | 100 |
| 25 | 105 |
| 30 | 110 |
| 35 | 113 |
| 40 | 114 |
| 45 | 115 |
| 50 | 110 |
| 55 | 80 |
| 60 | 75 |

EXAMPLE 6

15 kinds of heat exchanger tubes as the example 6 were manufactured by making it condition that the constituent elements were set to be equal to those of the heat exchanger tube as the example 3 except that the fin height h was varied within the range of R/80 to R/10 as small as the outside diameter R of the metal tube 1, and the meandering pitch P of each boundary portion a between the adjacent areas W1, W2 was set to 15W (W represents the cross-sectional peripheral length of the tube).

Subsequently, the measurement of the coefficient of heat transfer with condensation and that of the condensing pressure loss in the case of setting the flow rate of refrigerant to 200 kg/m$^2$s were made on each of the heat exchanger tubes as the example 6. The percentage of the coefficient of heat transfer with condensation in each of the above heat exchanger tubes as the example 6 is shown in Table 8, together with the percentage of the condensing pressure loss.

The percentage of the coefficient of heat transfer and that of the condensing pressure loss in each heat exchanger tube were given by making the measurement ten times on each heat exchanger tube in the state of a single tube by using a measuring device and then finding the average of the measured values to make a comparison by assuming the percentage of the coefficient of heat transfer with condensation and that of the condensing pressure loss in the heat exchanger tube having the fin height h of R/40 as the example 6 to be respectively 100.

As shown in Table 8, with the increasing fin height h, high coefficient of heat transfer with condensation was ensured, while the condensing pressure loss was increased. Judging from the above fact, it was ascertained that the preferable range of the fin height h was R/70 to R/15.

TABLE 8

(Fin height h, percentage of coefficient of heat transfer with condensation and percentage of condensing pressure loss, wherein flow rate of refrigerant is set to 200 kg/m$^2$ s and R represents the outside diameter of the tube)

| Fin height h (R to h ratio) | Percentage of coefficient of heat transfer (Heat exchanger tube having h of R/40 is assumed to be 100) | Percentage of condensing pressure loss (Heat exchanger tube having h of R/40 is assumed to be 100) |
|---|---|---|
| R/10 | 142 | 165 |
| R/15 | 136 | 130 |
| R/20 | 128 | 121 |
| R/25 | 121 | 116 |
| R/30 | 112 | 107 |
| R/35 | 107 | 104 |
| R/40 | 100 | 100 |
| R/45 | 97 | 96 |
| R/50 | 95 | 93 |
| R/55 | 94 | 91 |
| R/60 | 92 | 89 |
| R/65 | 91 | 87 |
| R/70 | 89 | 84 |
| R/75 | 79 | 70 |
| R/80 | 72 | 65 |

Seventh Embodiment

Figure 14:
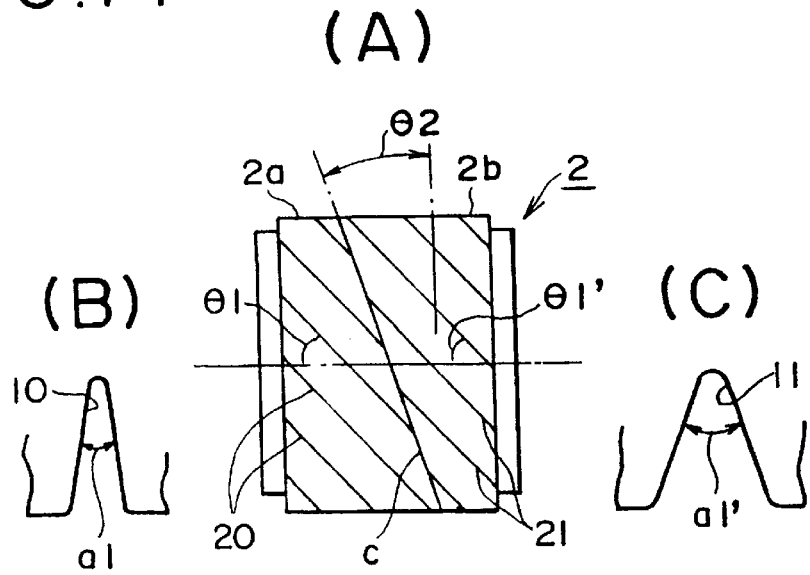
FIG. 14 (A) is a schematic front view showing a metal strip machining roll for manufacturing an internally-grooved heat exchanger tube in the seventh embodiment according to the present invention.

A metal strip machining roll 2 shown in FIG. 14 is formed by combining two roll pieces 2*a*, 2*b* together in layers parallel to the axial direction, and a large number of fine parallel grooves 20, 21 respectively having the reversed lead angles θ1, θ1' to the axial direction are formed on the surfaces of the adjacent roll pieces 2*a*, 2*b*. The bottom angle α1 of each groove 20 is set to be smaller than that α1' of each groove 21.

A contact surface c of the roll piece 2*a* with the roll piece 2*b* adjacent thereto is inclined at a predetermined inclination angle θ2 to a surface perpendicular to the axial direction of the roll 2.

Figure 15:
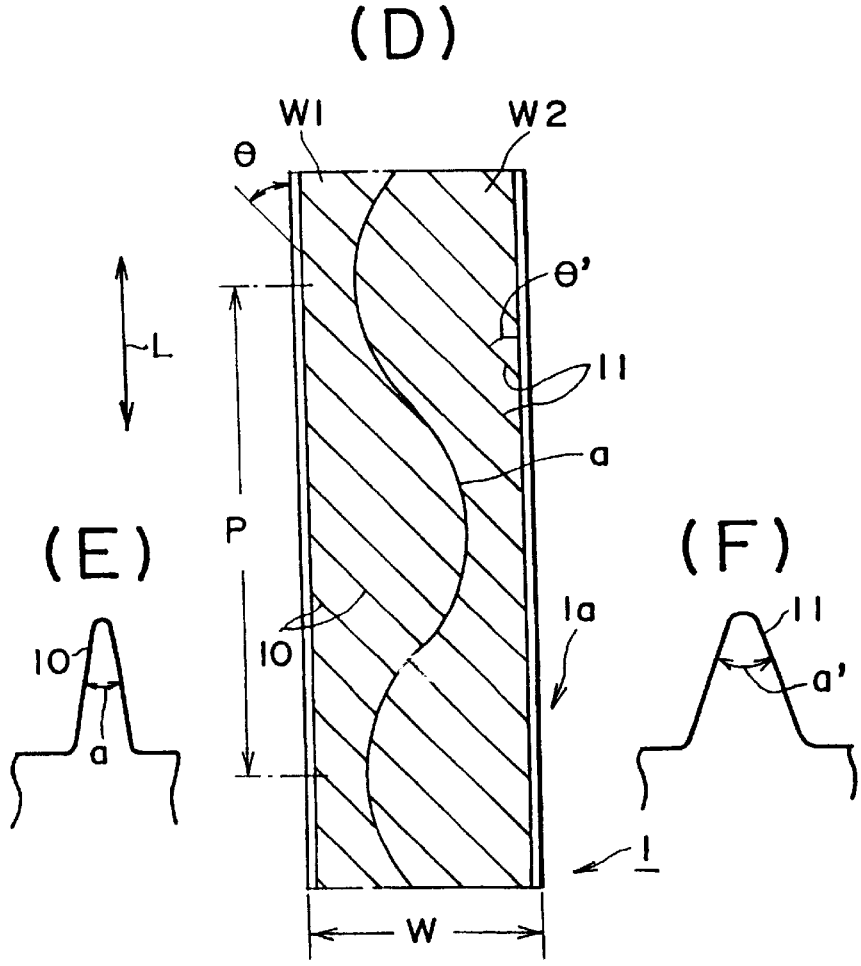
FIG. 15(D) is a partially development plan view schematically showing the internally-grooved heat exchanger tube in the seventh embodiment manufactured by using the machining roll of FIG. 14.
FIG. 15(E) is an enlarged sectional view showing a fin in one of areas of the internally-grooved heat exchanger tube of FIG. 15(D)
FIG. 15(F) is an enlarged sectional view showing a fin in the other area of the internally-grooved heat exchanger tube of FIG. 15(D)

In an internally-grooved beat exchanger tube in the seventh embodiment manufactured by using the metal strip machining roll 2 shown in FIG. 14, a rolled metal strip 1*a* is machined as shown in FIG. 15.

The internal surface of the internally-grooved heat exchanger tube in the seventh embodiment is divided into two areas W1, W2 correspondingly to the roll pieces 2*a*, 2*b*, and a boundary portion a meandering to the axial direction L of the tube at a certain pitch P is formed between the adjacent areas W1, W2 correspondingly to the contact surface c.

A large number of fine parallel fins 10 each having a predetermined lead angle θ to the axial direction L of the tube are formed in one area W1 out of the adjacent areas correspondingly to the grooves 20, while a large number of fine parallel fins 11 each having a lead angle θ' equal in direction and amount to the lead angle θ to the axial direction L of the tube are formed in the area W2 adjacent to the area W1 correspondingly to the grooves 21. The pitches of the fins 10, 11 are equal to each other.

The vertical angle α of each fin 10 in the area W1 is formed to be smaller than the vertical angle α' of each fin 11 in the area W2 according to the difference between the bottom angles α1, α1' of the grooves 20, 21.

According to the heat exchanger tube in the seventh embodiment, since the fins 10, 11 in the adjacent areas W1, W2 are different in vertical angle α, α', and besides, the boundary portion a between both the areas W1, W2 is formed in the state of meandering to the axial direction of the tube, the interference between the turbulent flows of refrigerant may be prevented by the butted portions of the fins in the boundary portion a before and behind the flow direction, and as a result, it is possible to provide an internally-grooved heat exchanger tube of higher heat transfer performance.

The heat exchanger tube in the seventh embodiment is substantially similar in other constitution, operation and effects to the heat exchanger tube in the first embodiment.

EXAMPLE 7

A metal strip made of deoxidized copper was used to manufacture 22 samples of heat exchanger tubes as the example 7 as shown in FIG. 15, that is, a heat exchanger tube structured such that the internal surface of the tube is divided into two continuous areas W1, W2 parallel to the axial direction of the tube, the cross-sectional peripheral length W (i.e., the width of the metal strip) is 20 mm, the thickness (i.e., the thickness of the groove bottom) t is 0.25 mm, the meandering pitch P of the boundary portion a between the adjacent areas W1, W2 is 15W (300 mm), the meandering width of the boundary portion a is 10 mm, each of the heights h, h' of the fins 10, 11 is 0.2 mm, each of the pitches p, p' of the fins 10, 11 is 0.30 mm, each of the lead angles θ, θ' of the fins 10, 11 to the axial direction L of the tube is 20°, and the fin vertical angles α, α' (except for one of the heat exchanger tubes) are not equal to each other by varying the vertical angle a of each fin 10 within the range of 5 to 30°, while varying the vertical angle α' of each fin 11 within the range of 10 to 35°.

Subsequently, the measurement of the percentage of the coefficient of heat transfer with condensation and that of the percentage of the condensing pressure loss in the case of setting the flow rate of refrigerant to 200 $Kg/m^2$ s were made on each of the heat exchanger tubes in the example 7. The percentage of the coefficient of heat transfer with condensation in each of the above heat exchanger tubes as the example 7 is shown in Table 9, together with the percentage of the condensing pressure loss. At the same time, the expansion of each heat exchanger tube was carried out (by pressing an expanding bar into the tube to expand the tube by a certain amount). The presence or absence of the fall of the fins at the time of expanding the tube is also shown in Table 9.

Incidentally, the percentage of the coefficient of heat transfer with condensation and that of the condensing pressure loss in each of the above heat exchanger tubes as the example 7 were given by making the measurement ten times on each of the heat exchanger tubes in the state of a single tube by using a measuring device and then finding the average of the measured values to make a comparison by assuming the percentage of the coefficient of heat transfer with condensation and that of the condensing pressure loss in the heat exchanger tube having the vertical angles α, α' of 25° for the fins 10, 11 to be respectively 100. As to the occurrence of the fall of the fins at the time of expanding the tube, the presence of the fall of the fins is expressed by X, while the absence of the fall of the fins is expressed by ○.

As shown in Table 9, when either of the fin vertical angles α, α' was less than 10°, the fall of the fins occurred at the time of expanding the tube. On the other hand, when either of the fin vertical angles α, α' exceeded 30°, it was ascertained that there was a tendency to increase the condensing pressure loss in excess of the improvement in the coefficient of heat transfer with condensation. Thus, the fin vertical angles α, α' are preferably selected from values within the range of 10 to 30°.

Further, it was also ascertained that the heat transfer performance could be improved by differentiating the fin vertical angles α, α' such as to set one of the fin vertical angles to be not more than 20° while setting the other fin vertical angle to be not more than 30°.

TABLE 9

(Percentage of coefficient of heat transfer with condensation, percentage of condensing pressure loss and presence or absence of fall of fins in expansion of tube in case of independently varying fin vertical angles α, α')

| Fin vertical angle α (°) | Fin vertical angle α' (°) | Percentage of coefficient of heat transfer with condensation | percentage of condensing pressure loss | Presence of absence of fall of fins in expansion |
|---|---|---|---|---|
| 5 | 10 | — | — | X |
| 5 | 15 | — | — | X |
| 5 | 20 | — | — | X |
| 5 | 25 | — | — | X |
| 5 | 30 | — | — | X |
| 5 | 35 | — | — | X |
| 10 | 15 | 130 | 121 | ○ |
| 10 | 20 | 125 | 117 | ○ |
| 10 | 25 | 120 | 115 | ○ |
| 10 | 30 | 115 | 112 | ○ |
| 10 | 35 | 109 | 111 | ○ |
| 15 | 20 | 120 | 110 | ○ |
| 15 | 25 | 114 | 108 | ○ |
| 15 | 30 | 110 | 107 | ○ |
| 15 | 35 | 104 | 105 | ○ |
| 20 | 25 | 108 | 103 | ○ |
| 20 | 30 | 104 | 101 | ○ |
| 20 | 35 | 99 | 100 | ○ |
| 25 | 25 | 100 | 100 | ○ |
| 25 | 30 | 100 | 97 | ○ |
| 25 | 35 | 88 | 91 | ○ |
| 30 | 35 | 76 | 89 | ○ |

Eighth Embodiment

Figure 16:
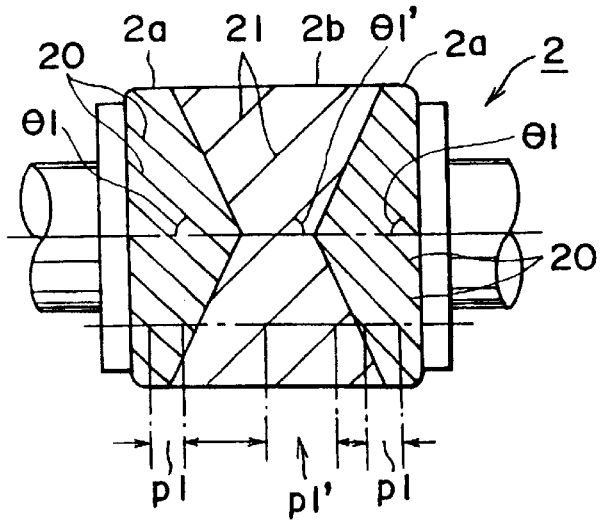
FIG. 16 is a schematic front view showing a metal strip machining roll for manufacturing an internally-grooved heat exchanger tube in the eighth embodiment according to the present invention.

A metal strip machining roll 2 shown in FIG. 16 is formed by combining three roll pieces 2*a*, 2*b*, 2*a* together in layers parallel to the axial direction.

A contact surface c of the left roll piece 2*a* with the center roll piece 2*b* and a contact surface c of the center roll piece 2*b* with the right roll piece 2*a* as shown in FIG. 16 are respectively composed of two continuous surfaces respectively inclined at the reverse inclination angles to a surface perpendicular to the axial direction of the roll 2, and the opposite contact surfaces c, c are formed in a symmetrical shape.

A large number of fine parallel grooves 20 each having a certain lead angle θ1 to the axial direction of the roll 2 are formed on the peripheral surfaces of the roll pieces 2*a*, 2*a*.

A large number of fine parallel grooves 21 each having the reversed lead angle θ1' of the lead angle θ1 to the axial direction of the roll 2 are formed on the peripheral surface of the center roll piece 2*b*.

Figure 17:
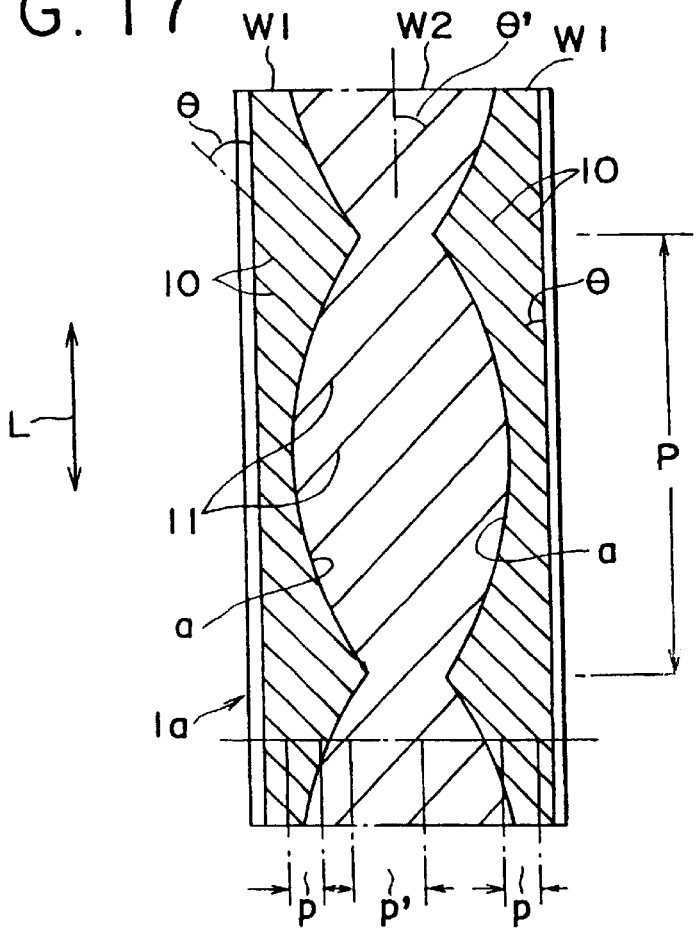
FIG. 17 is a partially development plan view schematically showing the internally-grooved heat exchanger tube in the eighth embodiment manufactured by using the machining roll of FIG. 16.

The grooves 20 on the peripheral surfaces of the roll pieces 2*a*, 2*a* are formed at a pitch (i.e., an interval between the centers of the bottom in the cross direction of the roll) p1 smaller than the pitch p1' of the grooves 21 on the center roll piece In an internally-grooves heat exchanger tube in the eighth embodiment manufactured by using the metal strip machining roll 2 shown in FIG. 16, a rolled metal strip 1*a* is machined as shown in FIG. 17.

A boundary portion a meandering to the axial direction L of the tube at a certain pitch P is formed between the adjacent areas W1, W2 and between those W2, W1 in order from the left of FIG. 17 correspondingly to the contact surfaces of the roll pieces 2*a*, 2*b*, 2*a* on the internal surface of the internally-grooved heat exchanger tube in the eighth embodiment. The boundary portions a, a are formed in the state of meandering in a symmetrical shape.

A large number of fine parallel fins 10 each having a predetermined lead angle θ to the axial direction L of the tube are formed in the opposite areas W1, W1, while a large number of fine parallel fins 11 each having the reversed lead angle θ' of the lead angle θ to the axial direction L of the tube are formed in the center area W2.

Since the pitch p1 of the grooves 20 of the roll 2 is smaller than the pitch p1' of the grooves 21, the fins 10 in the areas W1, W1 are also formed at a pitch p smaller than the pitch p' of the fins 11 in the center area W2.

According to the internally-grooved heat exchanger tube in the eighth embodiment, since not only the boundary portion a between the adjacent areas W1, W2 is formed in the state of meandering to the axial direction L of the tube, but also the lead angles θ, θ' of the fins 10, 11 in the adjacent areas W1, W2 are reversed, while the pitches p, p' of the fins 10, 11 are also different from each other, the interference between the flows of refrigerant in the joined portion of the fins 10, 11 in the boundary portion a less occurs, resulting in the greater improvement of heat transfer performance.

The internally-grooved heat exchanger tube in the eighth embodiment is substantially similar in other constitution, operation and effects to the internally-grooved heat exchanger tube in the sixth embodiment.

Other Embodiments

Figure 18:
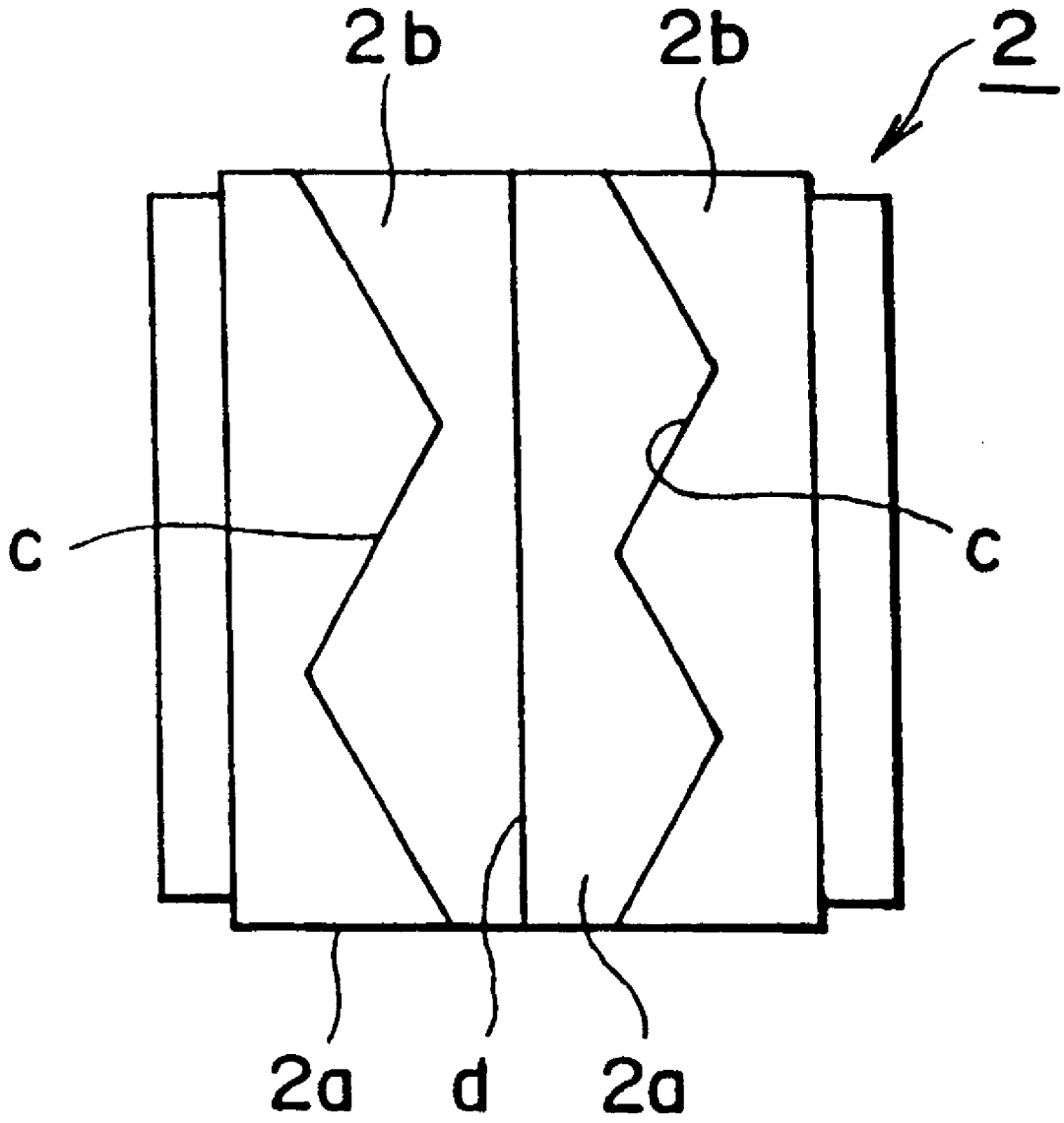
FIG. 18 is a schematic plan view showing a metal strip machining roll for manufacturing an internally-grooved heat exchanger tube in the yet further embodiment.

When a metal strip machining roll for an internally-grooved heat exchanger tube according to the present invention is formed by combining a set of roll pieces 2*a*, 2*b* adjacent to each other through a contact surface c composed of a plurality of F continuous inclined surfaces, and the other set of roll pieces 2*a*, 2*b* adjacent to each other through a contact surface c composed of a plurality of continuous inclined surfaces as shown in FIG. 18, each of the contact surfaces c, c need not be composed of the inclined surfaces of the same number.

Further, in the roll shown in FIG. 16 or 18, one contact surface c composed of a plurality of continuous inclined surfaces and the other contact surface c composed of one inclined surface are also useful.

Further, when the contact surface c is composed of the plurality of continuous inclined surfaces, the inclined surfaces need not be equal in length to each other.

In the internally-grooved heat exchanger tube according to the present invention, while the fins 10, 11 in the adjacent areas W1, W2 (or W2, W1) have preferably the reversed lead angles θ, θ' to the axial directions L of the tube similarly to the case of the above embodiments, it is to be understood that the lead angles θ, θ' may be different from each other without being reversed.

As long as the boundary portion a between the adjacent areas W1, W2 is formed in the state of meandering to the axial direction of the tube as a whole, a boundary portion having a portion formed parallel to the axis of the tube is also useful.

The reason is that even if the boundary portion a may have the portion parallel to the axial direction of the tube, the similar operation and effects to those described above may be also displayed in other meandering portions of the boundary portion.

The number of the areas W1, W2 formed in the tube may be varied according to the outside diameter of the tube.

POSSIBILITY OF INDUSTRIAL UTILIZATION

According to the internally-grooved heat exchanger tube in the present invention, in the case of letting the refrigerant flow within the tube parallel to the axial direction L of the tube, the refrigerant flows along the fins 10, 11 formed in the adjacent areas W1, W2 to form the turbulent flow in the boundary portion a between the areas W1, W2, so that this turbulent flow makes it possible to accelerate the exchange of heat between the refrigerant and the internal surface of the tube, resulting in the improvement in heat transfer efficiency.

At this time, since the boundary portion a between the areas W1, W2 for the formation of the turbulent flow of refrigerant is formed in the state of meandering to the axial direction L of the tube so that the positions of the turbulent-flow formed portion (the boundary portion a) of the refrigerant in the inner peripheral direction of the tube are different little by little before and behind the flow direction of refrigerant, the interference between the turbulent flows formed before and behind the flow direction of refrigerant is restrained to thereby make it possible to prevent the heat transfer efficiency from being reduced.

Further, since the turbulent-flow formed portion of refrigerant is shifted in a zigzag shape toward the inner side of the tube along the meandering boundary portion a, the temperature gradient parallel to the peripheral direction is restrained to thereby make it possible to more sufficiently improve the heat transfer performance.

According to the internally-grooved heat exchanger tube in the present invention as defined in claim 2, since the fins 10 formed in one area W1 out of the adjacent areas and the fins 11 formed in the other area W2 respectively have the reversed lead angles θ, θ' to the axial direction L of the tube, the collision between the flows of refrigerant occurs in the boundary portion a between the adjacent areas W1, W2 to form a more active turbulent flow, and as a result, the heat transfer performance is improved.

According to the internally-grooved heat exchanger tube in the present invention as defined in claim 3, since the boundary portion a between the adjacent areas W1, W2 is formed in the state of meandering to the axial direction L of the tube at a certain meandering pitch P, and the meandering pitch P is 8 to 60 times as large as the cross-sectional peripheral length W of the metal tube 1, the roll chipping may be prevented from occurring in the case of forming the fins on the metal strip for the heat exchanger tube, while higher heat transfer performance may be displayed.

According to the internally-grooved heat exchanger tube in the present invention as defined in claim 4, since the fins 10, 11 in the adjacent areas W1, W2 are substantially acute triangular in cross section, and the vertical angle a of each of the fins 10, 11 ranges from 10 to 30°, the heat transfer efficiency may be further improved.

According to the internally-grooved heat exchanger tube in the present invention as defined in claim 5, since each of the lead angles θ, θ' of the fins 10, 11 in the adjacent areas W1, W2 ranges from ±15 to ±50°, the heat transfer efficiency is further improved.

According to the internally-grooved heat exchanger tube in the present invention as defined in claim 6, since the height h of each of the fins 10, 11 in the adjacent areas W1, W2 is 1/15 to 1/70 as small as the outside diameter R of the metal tube 1, the heat transfer performance may be further improved while the increase of the pressure loss is restrained.

According to the metal strip machining roll for the internally-grooved heat exchanger tube in the present invention as defined in claim 7, since the plurality of roll pieces 2*a*, 2*b* are combined together in layers parallel to the axial direction, the large number of parallel grooves 20, 21 different in at least one selected among lead angle θ1, θ1' to the axial direction of the roll, bottom angle α1,α1' and groove pitch p1, p1' are formed on the outer surfaces of the adjacent roll pieces 2*a*, 2*b*, and the contact surface c of the roll piece 2*a* with the roll piece 2*b* adjacent to the roll piece 2*a* forms a surface inclined to the surface perpendicular to the axial direction of the roll, the rolled metal strip for manufacturing the internally-grooved heat exchanger tube according to the present invention may be machined industrially and smoothly.

According to the metal strip machining roll for the internally-grooved heat exchanger tube in the present invention as defined in claim 8, since the plurality of roll pieces 2*a*, 2*b* are combined together in layers parallel to the axial direction, the large number of parallel grooves 20, 21 different in at least one selected among lead angle θ1,θ1' to the axial direction of the roll, bottom angle α1,α1' and groove pitch p1, p1' are formed on the outer surfaces of the adjacent roll pieces 2*a*, 2*b*, and the contact surface c of the roll piece 2*a* with the roll piece 2*b* adjacent to the roll piece 2*a* is composed of the plurality of continuous surfaces respectively inclined to the surface perpendicular to the axial direction of the roll, the meandering pitch P of the boundary portion a between the adjacent areas W1, W2 may be made smaller in the case of machining the rolled metal strip for manufacturing the internally-grooved heat exchanger tube according to the present invention.

What is claimed is:

1. An internally-grooved heat exchanger tube, characterized in that:

the internal surface of a metal tube (1) is divided into a plurality of continuous areas (W1, W2) parallel to the axial direction (L) of the tube;

a large number of fine parallel fins (10,11) are respectively formed in the adjacent areas (W1, W2);

the fins (10) in one area (W1) out of the adjacent areas and the fins (11) in the other area (W2) are different in at least one selected among lead angle (θ,θ') to the axial direction (L) of the tube, fin vertical angle (α,α') and fin pitch (p, p'); and a boundary line (a) between at least one area (W1) and the other area (W2) adjacent to said area (W1) is formed in a state of meandering to the axial direction (L) of said metal tube (1).

2. An internally-grooved heat exchanger tube according to claim 1, wherein the fins (10) formed in one area (W1) out of the adjacent areas and the fins (11) formed in the other area (W2) respectively have the reversed lead angles (θ, θ') to the axial direction (L) of the tube.

3. An internally-grooved heat exchanger tube according to claim 2, wherein said lead angle θ of each fin (10) in one area (W1) out of the adjacent areas ranges from 15° to 50°, while said lead angle (θ') of each fin (11) in the other area (W2) ranges from −15° to −50°.

4. An internally-grooved heat exchanger tube according to claim 1, wherein said boundary portion (a) between the adjacent areas (W1, W2) is formed in the state of meandering to the axial direction (L) of the tube at a certain meandering pitch (P), and the meandering pitch (P) is 8 to 60 times as large as the cross-sectional peripheral length W of said metal tube (1).

5. An internally-grooved heat exchanger tube according to claim 2, wherein said boundary portion (a) between the adjacent areas (W1, W2) is formed in the state of meandering to the axial direction (L) of the tube at a certain meandering pitch (P), and the meandering pitch (P) is 8 to 60 times as large as the cross-sectional peripheral length W of said metal tube (1).

6. An internally-grooved head exchanger tube according to claim 1, wherein each of the fins (10, 11) in the adjacent areas (W1, W2) is substantially acute triangular in cross section, and the vertical angle (α) of each of the fins (10, 11) ranges from 10° to 30°.

7. An internally-grooved heat exchanger tube according to claim 2, wherein each of the fins (10, 11) in the adjacent areas (W1, W2) is substantially acute triangular in cross section, and the vertical angle (α) of each of the fins (10, 11) ranges from 10° to 30°.

8. An internally-grooved heat exchanger tube according to claim 1, wherein the height h of each of the fins (10, 11) in the adjacent areas (W1, W2) is 1/15 to 1/70 as small as the outside diameter R of said metal tube (1).

9. An internally-grooved heat exchanger tube according to claim 2, wherein the height (h) of each of the fins (10, 11) in the adjacent areas (W1, W2) is 1/15 to 1/70 as small as the outside diameter R of said metal tube (1).

10. A metal strip machining roll for an internally-grooved heat exchanger tube, comprising:

a roll of a predetermined length formed by combining a plurality of roll pieces (2*a*, 2*b*) together in layers parallel to the axial direction;

wherein a large number of fine parallel grooves (20, 21) are respectively formed on the outer surfaces of the adjacent roll pieces (2*a*, 2*b*);

the grooves (20) on one roll piece 2*a* out of the adjacent roll pieces and the grooves (21) on the other roll piece (2*b*) are different in at least one selected among lead angle (θ1, θ1') to the axial direction, bottom angle (α1, α1') and groove pitch (p1, p1'); and a contact surface (c) of at least one roll piece (2*a*) with the other roll piece (2*b*) adjacent to said roll piece (2*a*) forms a surface inclined at a predetermined inclination angle to a surface perpendicular to the axial direction of each of said roll pieces (2*a*, 2*b*).

11. A metal strip machining roll for an internally-grooved heat exchanger tube, comprising:

a roll of a predetermined length formed by combining a plurality of roll pieces (2*a*, 2*b*) together in layers parallel to the axial direction;

wherein a large number of fine parallel grooves (20, 21) are respectively formed on the outer surfaces of the adjacent roll pieces (2*a*, 2*b*);

the grooves (20) on one roll piece (2*a*) out of the adjacent roll pieces and the grooves (21) on the other roll piece (2*b*) are different in at least one selected among lead angle (θ1, θ1') to the axial direction, bottom angle (α1, α1')and groove pitch (p1, p1'); and a contact surface (c) of at least one roll piece (2*a*) with the other roll piece (2*b*) adjacent to said roll piece (2*a*) is composed of a plurality of continuous surfaces respectively inclined at different inclination angles to a surface perpendicular to the axial direction of each of said roll pieces (2*a*, 2*b*).

* * * * *

UNITED STATES PATENT AND TRADEMARK OFFICE

CERTIFICATE OF CORRECTION

PATENT NO. : 6,340,050 B1
DATED : January 22, 2002
INVENTOR(S) : Mori et al.

It is certified that error appears in the above-identified patent and that said Letters Patent is hereby corrected as shown below:

Title page,
Item [22], the PCT Filing Date should read:

-- [22] PCT Filed: Oct. 22, 1999 --

Signed and Sealed this

Seventeenth Day of September, 2002

*Attest:*

*Attesting Officer*

JAMES E. ROGAN
*Director of the United States Patent and Trademark Office*